US007256761B2

(12) United States Patent
Huang et al.

(10) Patent No.: US 7,256,761 B2
(45) Date of Patent: Aug. 14, 2007

(54) SCANNER INTEGRATED CIRCUIT

(75) Inventors: Juin-Ying Huang, Taoyuan (TW); Shih-Hsiung Huang, Pingjen (TW); Wen-Tse Tseng, Bade (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 327 days.

(21) Appl. No.: 10/462,638

(22) Filed: Jun. 17, 2003

(65) Prior Publication Data

US 2004/0174330 A1 Sep. 9, 2004

(30) Foreign Application Priority Data

Mar. 4, 2003 (TW) ..... 92104601 A

(51) Int. Cl.
*G09G 3/36* (2006.01)

(52) U.S. Cl. ..... 345/100; 345/98; 345/204; 345/208

(58) Field of Classification Search ..... 345/100, 345/98, 204, 208
See application file for complete search history.

(56) References Cited

U.S. PATENT DOCUMENTS

| | | | | |
|---|---|---|---|---|
| 3,946,320 | A * | 3/1976 | Overbury et al. | 455/161.3 |
| 5,160,190 | A * | 11/1992 | Farrell et al. | 312/201 |
| 6,040,828 | A * | 3/2000 | Park | 345/213 |
| 6,133,860 | A * | 10/2000 | Ryu et al. | 341/67 |
| 6,853,372 | B2 * | 2/2005 | Kanzaki et al. | 345/208 |
| 2003/0174116 | A1 * | 9/2003 | Maeda et al. | 345/98 |

FOREIGN PATENT DOCUMENTS

FR 2354603 * 1/1978

* cited by examiner

*Primary Examiner*—Richard Hjerpe
*Assistant Examiner*—Leonid Shapiro
(74) *Attorney, Agent, or Firm*—Troxell Law Office, PLLC

(57) ABSTRACT

A scanner integrated circuit comprises a gate integrated circuit including a shift register, a delay unit, a voltage detecting unit and a logic unit for achieving an output enable function so that the integrated circuit can reduce the pin numbers and the package volume and decrease the chip cost.

7 Claims, 7 Drawing Sheets

SCANNER INTEGRATED CIRCUIT

BACKGROUND OF THE INVENTION

1. Field of the Invention

The present invention relates to an integrated circuit, more particularly, and to a scanner integrated circuit discloses a gate integrated circuit applied.

2. Description of the Related Art

Referring to FIG. 1, the conventional driving circuit of liquid crystal display includes a panel 1 which comprises a plurality of gate driving integrated circuits 10 in X coordination and source driving integrated circuits 11 in Y coordination. And, the gate driving integrated circuit 10 connects to a gate (not shown in FIG. 1) for controlling the switch of each array of transistor, an array transistor once open when the scanner circuit operates. When the transistor is at ON state, the source driving integrated circuit 11 controls the control voltage of the brightness, grey scale and color to enter the pixels of panel 1 by using the source and drain of transistor to form a channel.

Referring to FIG. 2, the conventional gate integrated circuit 20 connects to a timing controller 21 which includes an output enable signal outputting to the gate integrated circuit for enabling the gate integrated circuit. A start vertical clock signal outputted to the gate integrated circuit and a vertical clock signal inputted to the gate integrated circuit is shown as FIG. 3. The operation is according to when the output enable is high-level (OE=high), the gate output is low-level ($G_{out}$=low). Whereas, when the output enable is low-level (OE=low), the gate output is high-level ($G_{out}$=high). Referring to FIG. 3, the gate output includes a first output signal and a second output signal, wherein the first output signal is enabled by a first impulse of the output enable signal and the second output signal is enabled by a second impulse of the output enable signal. Therefore, the output signals after the output enabling have time gap for eliminating the dull display in accordance with the pre-output charge/discharge effect.

The conventional gate integrated circuit with the output enable function has to need 3 input pins and packs on the tape carrier package having 6 input pin spaces. So, the cost of package, material and cabling is high.

For solving above mentioned problems, the present invention discloses a scanner integrated circuit for reducing the input pins of the output enable signal to decrease the volume of package, the surround cabling and the costs of the elements.

SUMMARY OF THE INVENTION

It is an object of the present invention to provide a scanner integrated circuit which discloses a gate integrated circuit comprising an output enable circuit for decreasing the 3 pins and 6 TCP spaces in the integrated circuit package process to get the effect of low cost.

To achieve these and other advantages and in order to overcome the disadvantages of the conventional device in accordance with the purpose of the invention as embodied and broadly described herein, the present invention provides a shift register receiving a vertical clock signal and generating a first signal; a delay unit revived form said first signal and being generated second signal by delaying said fist signal; a voltage detecting unit filtering said second signal to get a third signal; and a logic unit for comparing said first and third signal outputting an output signal after logic operation.

It is to be understood that both the foregoing general description and the following detailed description are exemplary, and are intended to provide further explanation of the invention as claimed.

BRIEF DESCRIPTION OF THE DRAWINGS

The accompanying drawing is included to provide a further understanding of the invention, and is incorporated in and constitutes a part of this specification. The drawing illustrates an embodiment of the invention and, together with the description, serves to explain the principles of the invention. In the drawing.

DETAILED DESCRIPTION OF THE PREFERRED EMBODIMENTS

Figure 1:
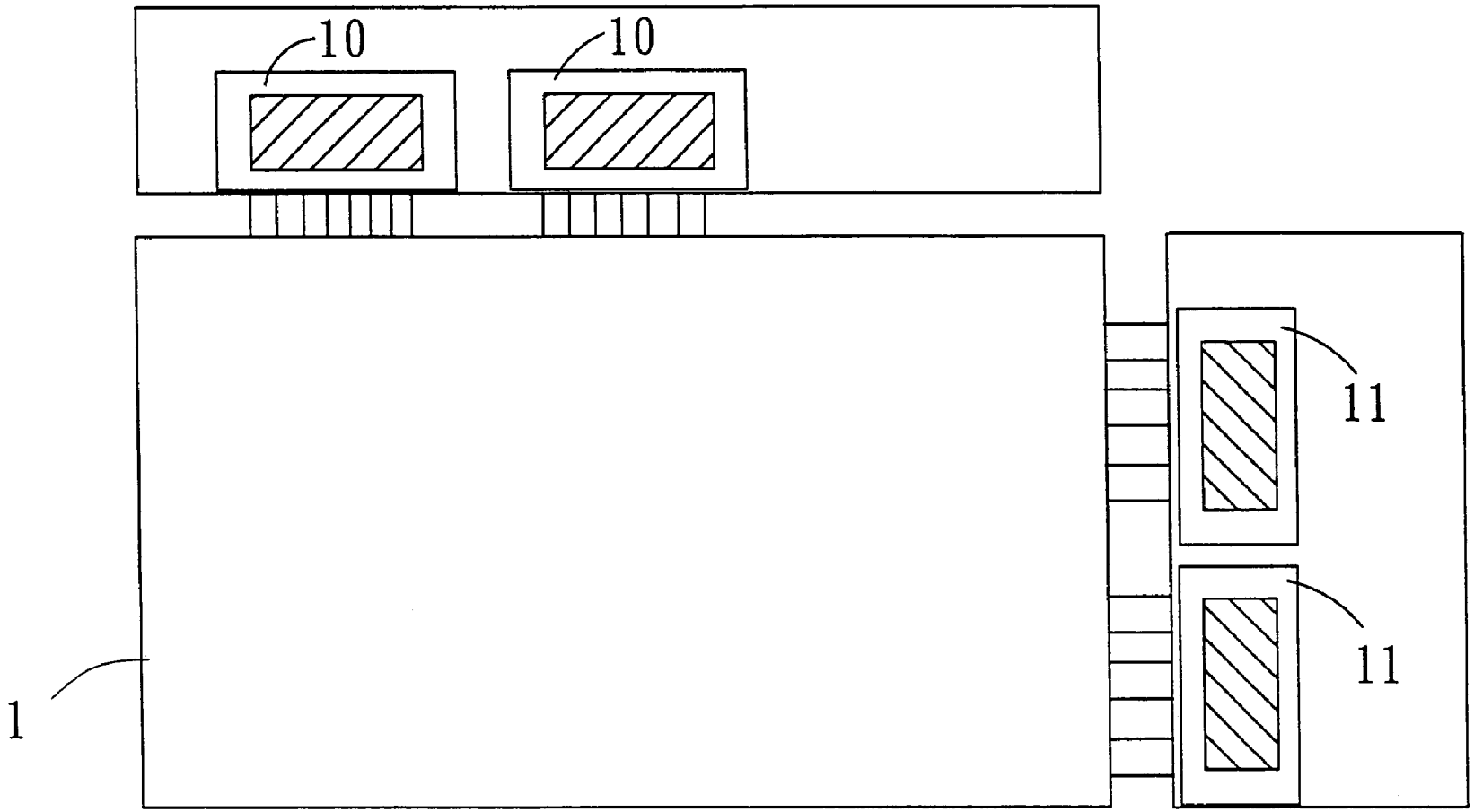
Fig1. (Prior art)
FIG. 1 is an illustrated view showing the conventional driving circuit of the liquid crystal display of the prior art.
Figure 2:
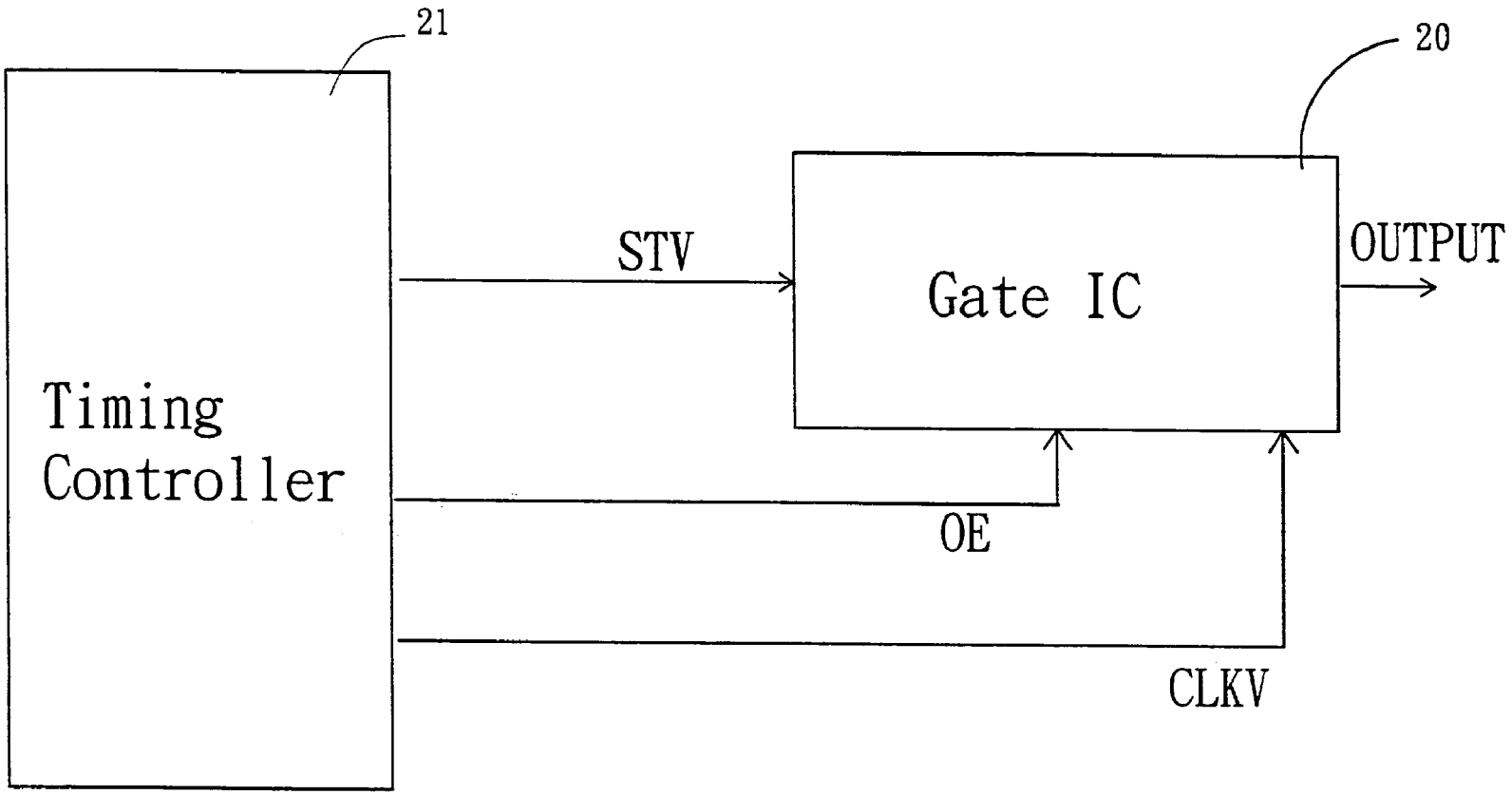
Fig2. (Prior art)
FIG. 2 is a circuit block diagram showing the conventional gate integrated circuit of the prior art.

Reference will now be made in detail to the preferred embodiments of the present invention, examples of which are illustrated in the accompanying drawings. Wherever possible, the same reference numbers are used in the drawings and the description to refer to the same or like parts.

Figure 4:
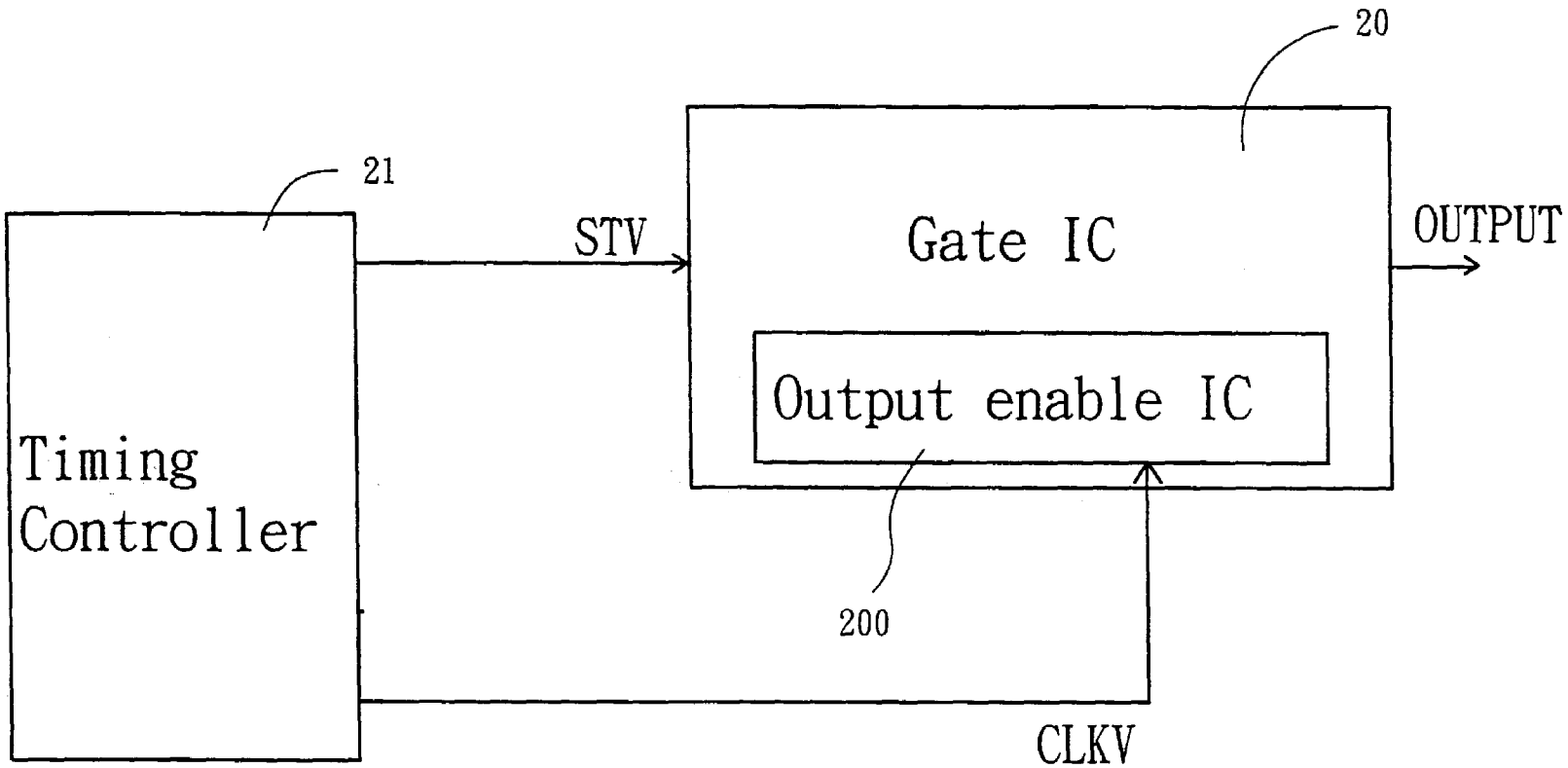
FIG. 4 is a circuit block diagram showing the scanner integrated circuit in accordance to an embodiment of the present invention.

Referring to FIG. 4, a scanner integrated circuit of the present invention comprises an output enable circuit 200 in a gate integrated circuit connecting to a timing controller 21 for receiving a start vertical clock impulse (STV) inputted. And, the output enable circuit 200 receives a vertical impulse signal (CLKV) inputted.

Figure 5:
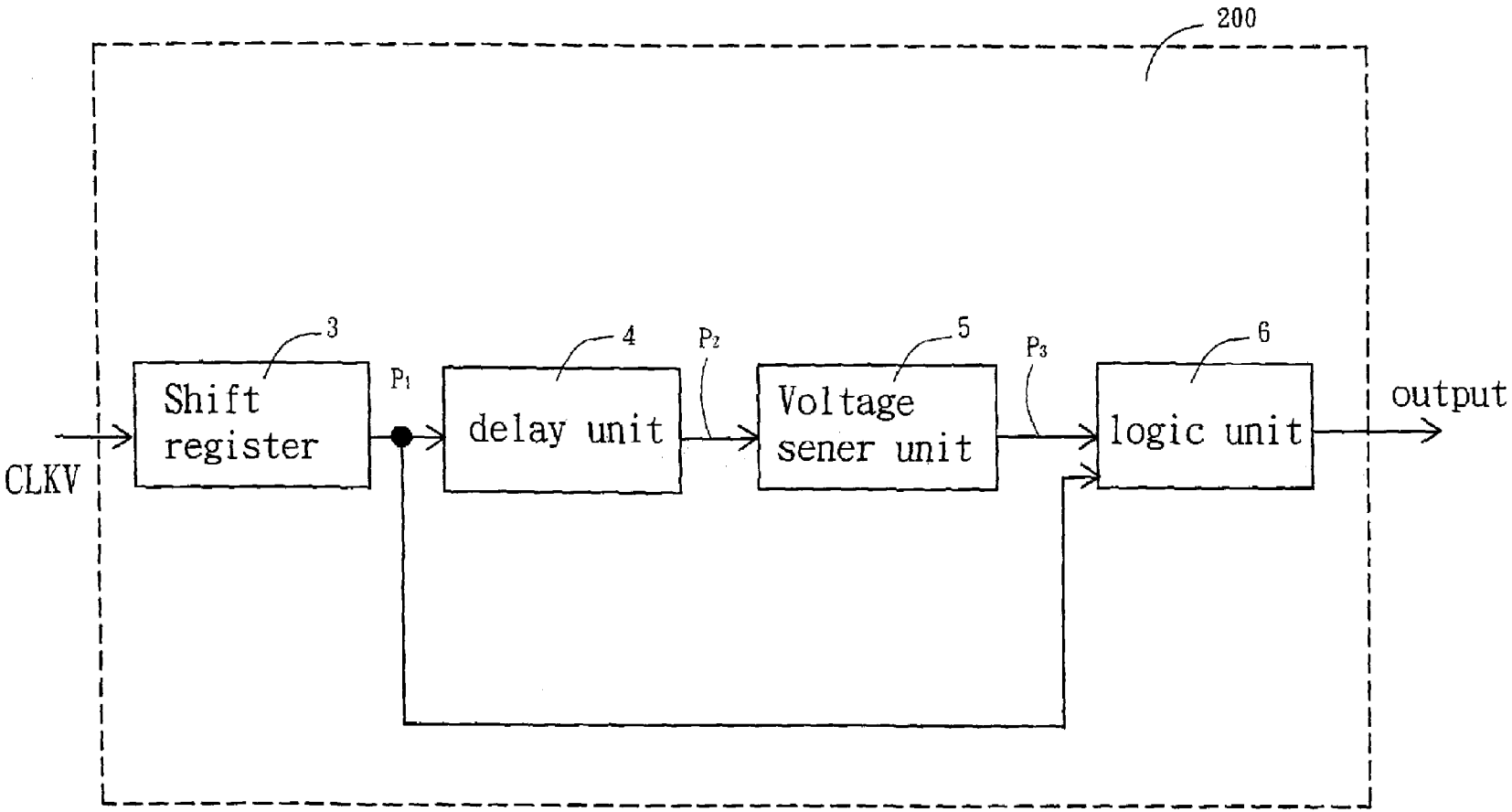
FIG. 5 is a block diagram showing the output enable circuit of the gate integrated circuit of FIG. 4 in accordance to an embodiment of the present invention.

Referring to FIG. 5, the output enable circuit 200 comprises a shift register 3 for receiving the vertical impulse signal to output a first signal P1 at P1 point; a delay unit 4 connecting to the shift register 3 for receiving the first signal P1 and outputting a second signal P2; a voltage detecting unit 5 detecting the second signal P2 inputted and filtering the second signal to a third signal P3; and a logic unit 6 comparing the first signal and the second signal to output a gate output signal after logic computing.

Figure 6:
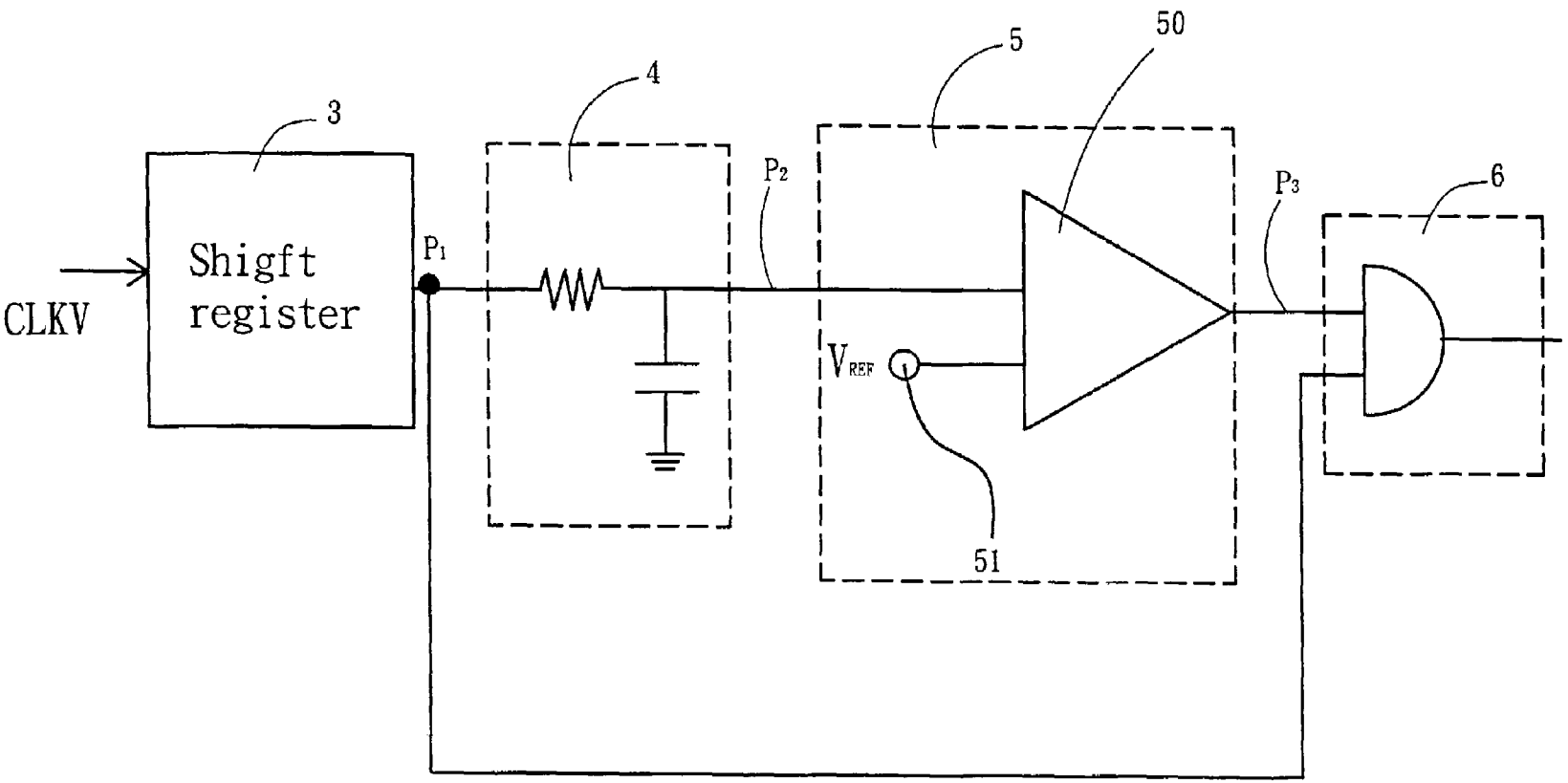
FIG. 6 is a circuit diagram showing the output enable circuit of FIG. 5 in accordance to an embodiment of the present invention.

Referring to FIG. 6, the delay unit 4 of the output enable circuit 200 comprises a RC timing delay circuit which is composed of a resistor 40 and a capacitor 41 connecting each other. Further more, the voltage detecting unit 5 being a compare circuit comprises a comparator 50 and a reference voltage 51, wherein an input of the comparator 50 receives the second signal P2 and compares with the reference voltage 51 to output the third signal P3. And, the logic unit 6 being an AND gate compares the first signal P1 with the second signal P3 to output a gate output signal after logic computing.

Figure 3:
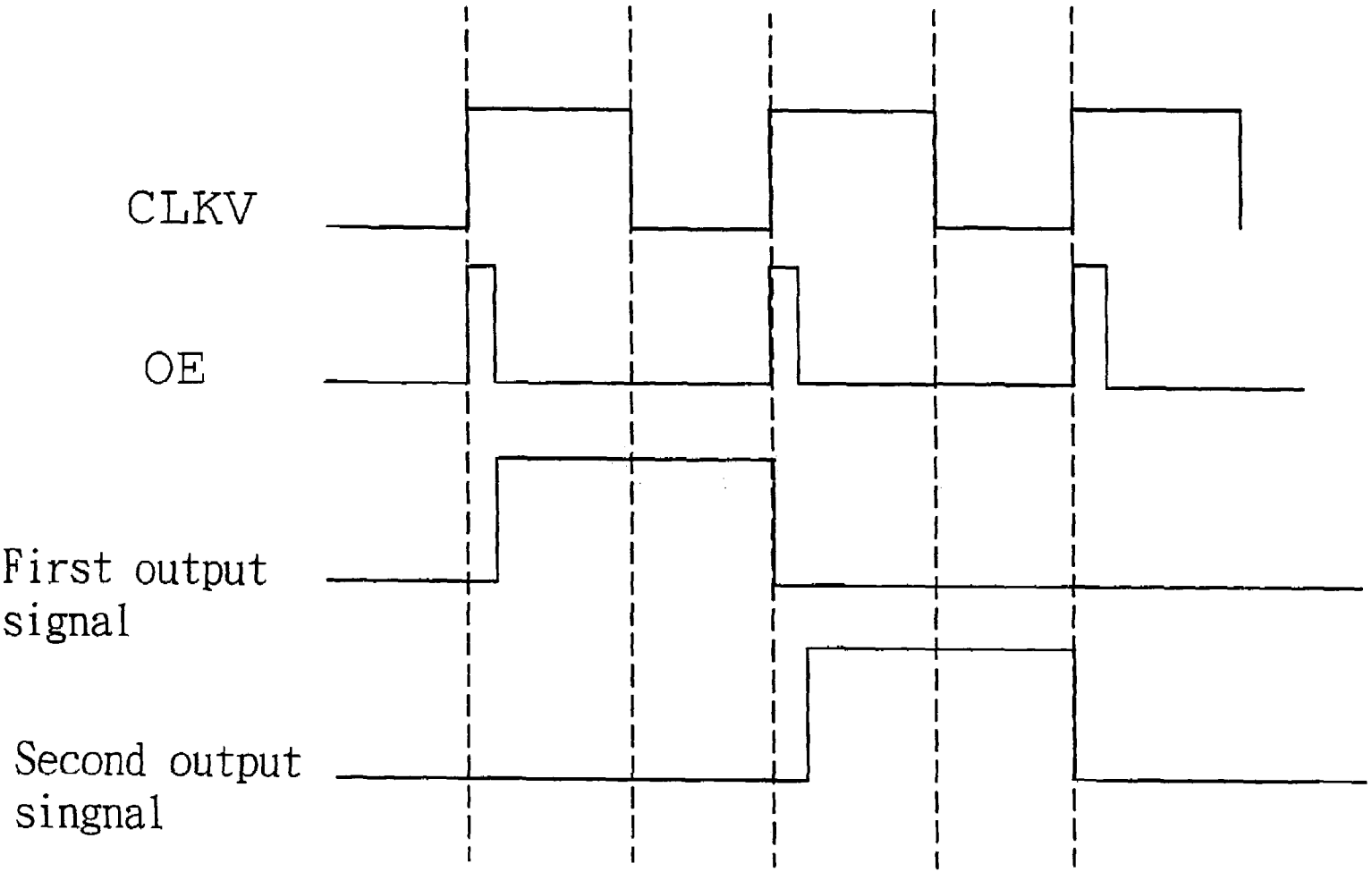
Fig3. (Prior art)
FIG. 3 is a timing diagram showing the conventional gate integrated circuit of FIG. 2 of the prior art.
Figure 7:
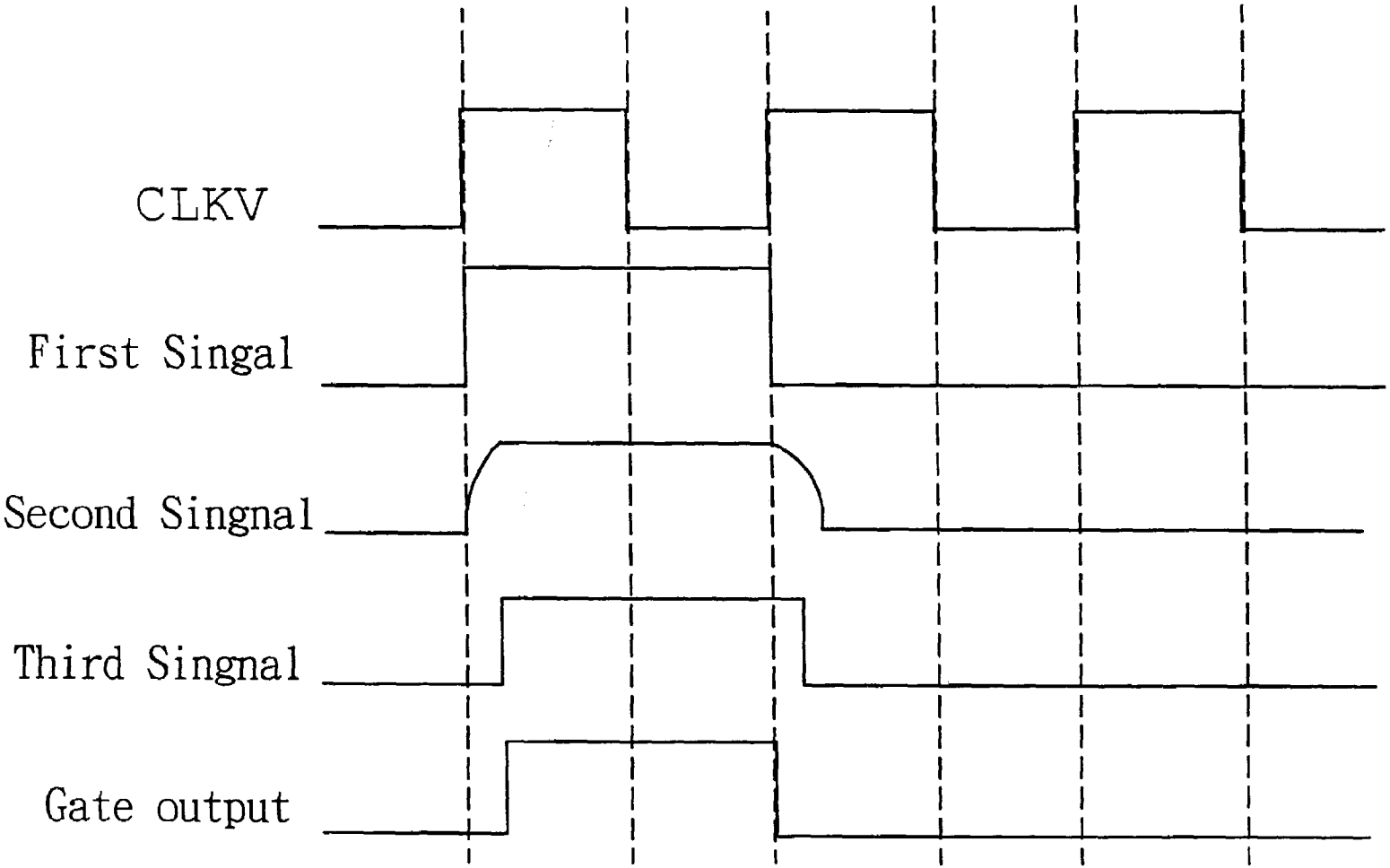
FIG. 7 is a timing diagram showing the output enable circuit of FIG. 5 in accordance to an embodiment of the present invention.

Referring to FIG. 7, the vertical impulse signal (CLKV) inputs a period square wave into the output enable circuit. The first signal P1 is outputted a positive half-wave with twice period frequency by the shift register; the second signal P2 is outputted by the delay circuit; the third signal is a square wave signal compared with the reference voltage by the comparator; and the gate output signal is a square wave signal after taking the first signal and the second signal logic compute. The output signal of the gate output signal of the present invention is the same as the conventional output signal as shown in FIG. 3 so that there is the same output signal of both but has lower pin numbers.

The present invention discloses above mentioned circuit having an effect which decrease the 3 pins and 6 TCP pin spaces in the integrated circuit package process. Therefore, the integrated circuit of the present invention decreases the cost of the integrated circuit package and the element. Further more, the timing controller (TCON) can decrease one input pin of the output enable signal (OE) so that the package can be reduced and simplify the complex internal microcircuit. The cabling of surround circuit can make the chip and elements shrinkage so that the cost can be reduced.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A scanner integrated circuit comprising an output enable circuit in a gate IC, wherein said output enable circuit comprises:

a shift register receiving a vertical clock signal and generating a first signal;

a delay unit revived from said first signal and being generated a second signal by delaying said first signal;

a voltage detecting unit filtering said second signal to get a third signal; and a logic unit for comparing said first and third signals, outputting an output signal after logic operation, wherein said output enable circuit in a gate IC being inputted a start vertical signal to start by a timing controller; and said output enable circuit receiving a vertical clock signal from said timing controller to generate an output signal, wherein the shift register is directly connected with the delay unit.

2. The scanner integrated circuit in accordance with claim 1, wherein said delay unit being a RC delay circuit is composed of a resistor and a capacitor connecting each other.

3. The scanner integrated circuit in accordance with claim 1, wherein said voltage detecting unit being a compare circuit includes a comparator and a reference voltage; whereby an output of said comparator receiving said second signal compares with said reference voltage to output said third signal.

4. The scanner integrated circuit in accordance with claim 1, wherein said logic unit is an AND gate.

5. The scanner integrated circuit in accordance with claim 1, wherein the shift register is CLKV.

6. The scanner integrated circuit in accordance with claim 1, wherein the delay unit is connected to a voltage sensor unit.

7. The scanner integrated circuit in accordance with claim 4, wherein an input of the logic unit receives P1 processed by the shift register.

* * * * *